US005584726A

United States Patent [19]

Le Gallic et al.

[11] Patent Number: 5,584,726

[45] Date of Patent: Dec. 17, 1996

[54] DEVICE FOR ATTACHMENT AND LOCKING OF A MODULE ONTO A SUPPORT, NOTABLY PROVIDED WITH A CORRECTOR, AND ITS APPLICATION TO THE COUPLING OF COMPLEMENTARY ELECTRICAL CONNECTORS

[75] Inventors: Herve Le Gallic, Cherreau; Pascal M. Ribeau, Le Mans, both of France

[73] Assignee: Framatome Connectors International, Paris, France

[21] Appl. No.: 441,601

[22] Filed: May 15, 1995

[30] Foreign Application Priority Data

May 24, 1994 [FR] France ..... 94 06258

[51] Int. Cl.[6] ..... H01R 13/73

[52] U.S. Cl. ..... 439/573; 439/680; 248/27.1

[58] Field of Search ..... 439/573, 544, 439/545, 562, 563, 569, 570, 680, 681; 248/27.1

[56] References Cited

U.S. PATENT DOCUMENTS 3,555,491 1/1971 Moss ..... 339/92

4,032,213 6/1977 Snyder et al. ..... 339/186 M 4,721,470 1/1988 Humphrey ..... 439/573

FOREIGN PATENT DOCUMENTS

4016890A1 11/1991 Germany .

*Primary Examiner*—David L. Pirlot
*Assistant Examiner*—Eugene Byrd
*Attorney, Agent, or Firm*—Perman & Green

[57] ABSTRACT

The device (5) according to the invention comprises a cylindrical body (50). The outer base of the body (50) has a crown piece with correction catches (501) engaging in a second crown piece of correction catches (30) of a connector (3). The number of correction positions between the body (50) and the connector (3) is equal to the number of catches (501, 30). An elastic washer permits a partial drawings back of device (5) to permit changing the correction position. According to a first mode of embodiment, the cylindrical body is extended by a threaded shaft and screwed onto the connector (3). According to a second mode of embodiment, a key system (54, 542, 543) acts on a latch (6) sliding inside connector (3), which permits locking onto a support (4). This key system is activated by a tool of the screwdriver type. The device can be used for coupling of complementary electrical connectors, notably for aeronautic applications.

11 Claims, 6 Drawing Sheets

Δℓ
Δt
1
2
3
4
5
6
7
8
31
32
33
41
542
543
70

DEVICE FOR ATTACHMENT AND LOCKING OF A MODULE ONTO A SUPPORT, NOTABLY PROVIDED WITH A CORRECTOR, AND ITS APPLICATION TO THE COUPLING OF COMPLEMENTARY ELECTRICAL CONNECTORS

BACKGROUND OF THE INVENTION

The present invention concerns a device for attachment and locking of modules onto a support, particularly for complementary electrical connectors designed to be coupled.

It concerns more particularly, a device furnished with a corrector device for attachment and locking of modules to be coupled onto a support.

In the case of connectors, connectors of the male and female type are most often understood as "complementary".

Numerous types of corrector devices are known, notably in the field of electrical connectors. The most current technique to which we have recourse consists of using connectors of asymmetrical form or having guide marks to be aligned.

The correction devices of the known art correctly fulfill, for the most part, the function that they are assigned. Nevertheless, they have limited [application] possibilities. In general, the only function assigned to these correctors is the prevention of a "reverse" branching of a connector of a first type, to be coupled to a connector of a second type, for example, a male connector and a female connector, or their only function is to obtain a good relative orientation of these connectors. This is, for example, in computer technology, the case for connectors used to establish connections called "serial" or "parallel", connectors in telephony or for transmission applications, connectors available commercially under the reference RJxx, a reference in which xx is a number representing the number of contacts that the connector has, or in the audiofrequency field, for plugs and sockets commonly called "DIN".

Nevertheless, in a complex connection system, for example, a mixing box in computer or telephone applications, different signal configurations exist for each connector, or at least for some of the connectors associated with this box, it is necessary to distinguish pairs of connectors, male and female, as configurations of distinct signals. It is obvious that the corrector devices that have just been described cannot resolve the problem posed, i.e., the correct pairing of connectors of distinct configurations.

Moreover, it may be necessary to modify the cabling, when the architecture of a system is developed, for example, the architecture of a computer network. Therefore, correction systems involving fixed solutions cannot be adopted.

Also, it has been proposed to use multiposition correction devices that can be modified as desired, so as to be able to select any one of these positions. U.S. Pat. No. 4,032,213 (THE BENDIX CORPORATION) describes a correction device of this type.

As has just been suggested, it is important for industrial applications to use connectors conforming to standards, or at least to actual usage. They must therefore be able to be adapted to numerous conditions of use, and notably to varied technological environments. In the above-mentioned connection systems, for example, mixing boxes, the thickness of the panels supporting the connectors, commonly called the basket support, can vary within appreciable proportions. It is important that connectors of the same type can be adapted to such variations in dimensions.

It is also desirable that the connectors mounted on said panel are removable, or at least can be detached, without necessitating complex operations.

SUMMARY OF THE INVENTION

The invention has for a subject an attachment and locking device for a pair of modules to be coupled onto a support, permitting simultaneous conformance to requirements that are made in the field of connections.

In a preferred variant of embodiment, the device according to the invention permits obtaining, notably and simultaneously, in addition to the function of attachment and locking, a multiposition correction function that can be modified as desired.

The device according to the invention can be presented according to two principal modes of embodiment.

According to a first mode, or a simplified mode of embodiment, components of the screw and nut type are used.

According to a second mode of embodiment, or a preferred mode, a component of the bolt type is used, rendering the connector removable without disassembly. This mode of embodiment permits, moreover, a good adaptability to variations of thickness of support walls or basket supports.

The invention therefore has for a subject a device for attaching and locking a module of a first type onto a support, this module comprising at least one such locking device, characterized in that it is furnished with correcting means comprising:

- a first assembly of a specific number of correction catches, borne by one of the module surfaces,
- a body cut out into a specific profile and having on one surface facing said first correction catch assembly a second correction catch assembly, with a number [of catches] equal to said predetermined [specific] number;
- in that it comprises, realized in this module, an opening passing completely through it along with a direction parallel to said reference axis, a threaded shaft introduced into said opening, screwing means adapted to the threaded shaft, which are positioned on a surface opposite said first assembly and pressing said body onto said first assembly, and elastic means positioned between said opposite surface and the screwing means;
- and in that said threaded shaft permits the ratcheting into a specific relative position of said second correction catch assembly onto said first correction catch assembly, defining a particular correction position among a number of positions equal to said specific number, each particular position defining a distinct spatial position of said profile determined with regard to a reference axis, so as to permit coupling this module to a second module of a type complementary to said first type and comprising correction means, if, and only if, said specific profiles of the cut-out bodies of the correction means associated with each of the modules are in spatial positions complementary to one another, permitting their interlocking by translation along said reference axis.

The invention also has for a subject an attachment and locking device for a module of a first type onto a support, this module comprising at least one such locking device, characterized in that it is furnished with correction means comprising:

a first assembly of correction catches of a specific number, borne by one of the module surfaces, a body cut out into a specific profile and having on a surface facing the first correction catch assembly a second correction catch assembly, with a number [of catches] equal to the predetermined [specific] number;

in that it has a shaft, extending along a direction parallel to said reference axis, furnished with a projection into a median zone and bearing elastic means on a first end, a cavity realized in said module, a first opening realized in a central zone of said first correction catch assembly and emerging into said cavity, of sufficient size to allow the free passage of said shaft and said projection, and a second opening, of sufficient size to allow the free passage of at least the first end of said shaft, connecting the cavity to a surface opposite said first assembly;

in that said body is a cylindrical housing furnished with an opening of sufficient size to allow the free passage of said shaft and said projection, the first and second openings extending along a direction parallel to said reference axis, the relative sizes of said projection and said cavity being such that the projection can move in the cavity when the shaft is rotated around said reference axis;

in that the cavity communicates with the outside of the module; in that a component forming a latch, of a section adapted to the section of the cavity so as to be able to be moved by a translation movement along an axis roughly orthogonal to said reference axis, is introduced into this cavity;

and in that said shaft permits ratcheting into a specific relative position of said second correction catch assembly onto said first correction catch assembly, defining a particular correction position from among a number of positions equal to said specific number, each particular position defining a distinct spatial position of said profile determined with regard to a reference axis, so as to permit a coupling of this module to a second module of a type complementary to said first type and comprising correction means, if, and only if, said specific profiles of the cut-out bodies of the correction means associated to each of the modules are in spatial positions complementary to one another, permitting their interlocking by translation along said reference axis.

The invention has finally for a subject an attachment and locking device for a module of a first type onto a support, this module comprising at least one such locking device, characterized in that it comprises, realized in said module, an opening passing completely through in a direction parallel to said reference axis, a shaft furnished with a projection, being extended in this direction into a median zone and bearing elastic means on a first end;

in that the module has a cavity, a first opening on a first surface emerging into said cavity, of sufficient size to allow the free passage of said shaft and said projection, and a second opening on a second surface opposite the first, of sufficient size to allow the free passage of at least the first end of said shaft, the first and second openings being extended in a direction parallel to said reference axis, the relative dimensions of said projection and said cavity being such that the projection can be moved in the cavity when the shaft is rotated around said reference axis;

in that the cavity communicates with the outside of the module;

in that a component forming a latch, of a section adapted to the section of the cavity so as to be able to be moved according to a translation movement along an axis roughly orthogonal to said reference axis, is introduced into this cavity.

BRIEF DESCRIPTION OF THE DRAWINGS

The invention will be better understood and other characteristics and advantages will appear upon reading the description that follows in reference to the attached figures, and among which.

DETAILED DESCRIPTION OF THE INVENTION

Figure 1:
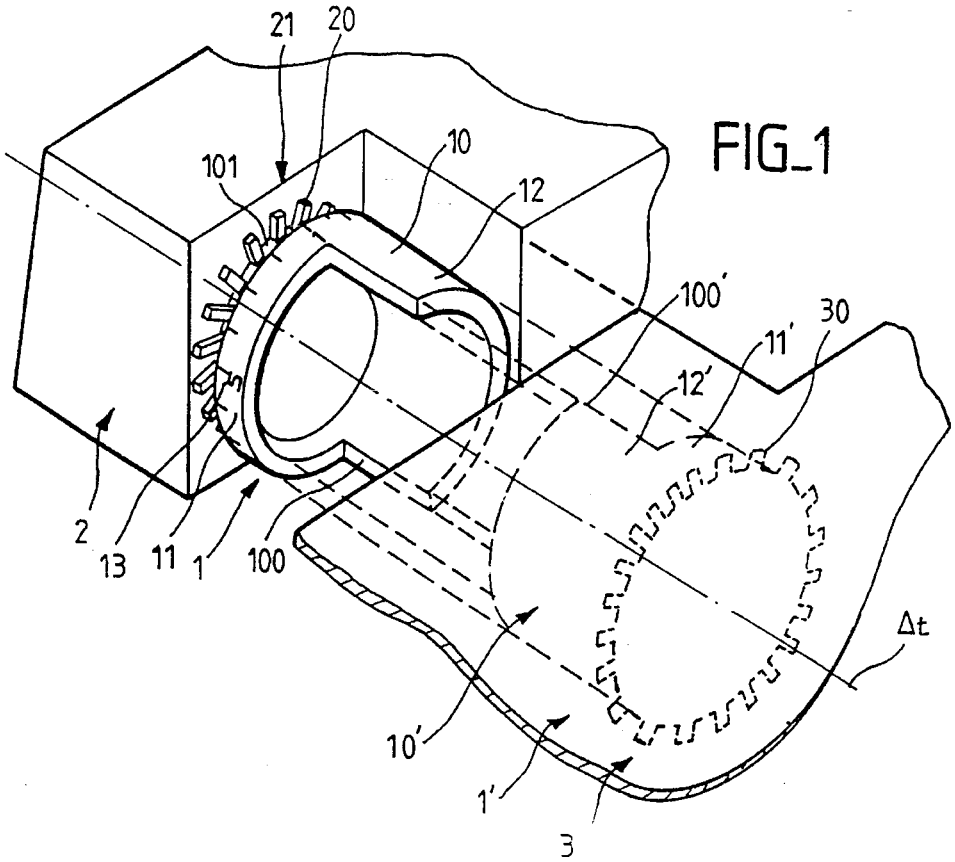
FIG. 1 illustrates schematically the operating principle of correction devices that can be associated with the attachment and locking device according to the invention.

First of all, with reference to FIG. 1, the operation of correction devices that can be used to advantage within the scope of the invention will be illustrated schematically. These correction devices have a multiposition correction function that can be modified as desired. The correction device illustrated by FIG. 1 assumes the principal arrangements described in the precited patent U.S. Pat. No. 4,032,213. In this figure, only the principal elements of the correction device necessary for a good understanding of the correction function alone have been shown.

Throughout the following, for the purpose of simplification, we will denote corrector as the "correction device" and device as the "attachment and locking device according to the invention". In a similar manner, without this being limiting with respect to the scope of the invention, we will concern ourselves with female connectors positioned on a basket support, called hereinafter support, to which male connectors must be coupled.

Within the scope of the invention, the notions of male and female are applied, above all, to the configuration of the casings and not to the type of contacts with which the connectors are furnished. To prevent any ambiguity, the term male or female casing will be used in preference to the term connector.

The correction part of the device, 1 or 1', comprises two principal parts: a hollow body, 10 or 10', of a roughly cylindrical shape and a toothed crown piece or correction catch crown, 20 or 30. This latter crown is of one piece with one of the two casings, 2 or 3, to be coupled.

In FIG. 1, it is assumed that casing 2, of which only a small portion is shown, is of the male type and casing 3, of the female type. Casing 2 can therefore be embedded in casing 3, with the express condition that the device correctors, 1 and 1', permit it Advantageously, each body, 10 and 10', of the corrector, is given a profile that only allows a crown of short height 11 and 11', to exist at the base of the body, and a half-cylinder or skirt, 12 and 12', is present over the rest of the height.

Each body 10–10' also has, at its base, a toothed crown piece or crown of correction catches of which only one is shown, 101, for body 10. This crown of correction catches has a configuration complementary to that of 21, of one piece with casing 2. Although not shown, for purposes of simplifying the figure, similar arrangements are provided for device 1' and casing 3.

The two bodies, 10 and 10', are rotated around a common axis $\Delta_t$ that we will call the transverse axis throughout the following.

On the two bodies, 10 and 10', of device correctors 1 and 1', or more precisely on crowns 11 and 11', are positioned a series of guide marks, of which only one, 13, is illustrated. These guide marks, shown by numbers, are in bi-univocal relation with the positions of the correction catches of crown 101. Each casing, 2 and 3, also has a single guide mark, of which only one, 21, has been shown. In order to define a particular correction position, according to one of the principal characteristics of the invention, the toothed crown 101 is turned around axis $\Delta_t$ and the latter is engaged in the correction catches of the corresponding crown 21. A number of correction positions equal to the number of correction catches of each crown can thus be defined. The number of its guide mark 13 borne by crown 11 placed facing guide mark 21 defines the correction position taken.

Since identical arrangements are adopted for device 1', casings 2 and 3 can only be coupled if the correction positions are adequate. In the example illustrated, the correction position is position "1", a position that is assimilated to the number of the series of guide marks 13 in coincidence with guide mark 21. It is therefore necessary that the correction position taken by the corrector associated with device 1' be identical. In this case, since the two device correctors 1 and 1' are placed head down, with transverse axis $\Delta_t$ as a common axis, it is possible to couple casings 2 and 3, due to the complementary profiles, 100 and 100', made in skirts 12 and 12' of the correctors.

We will now describe in a more detailed manner examples of practical embodiment for attachment and locking devices according to the invention, advantageously associated with a corrector of the type that has just been described. As has been mentioned, attachment and locking devices according to the invention can be realized according to two principal variants of execution.

Throughout the following, identical elements, or elements at least similar to those described have the same reference numbers and will only be redescribed if necessary.

Figure 2:
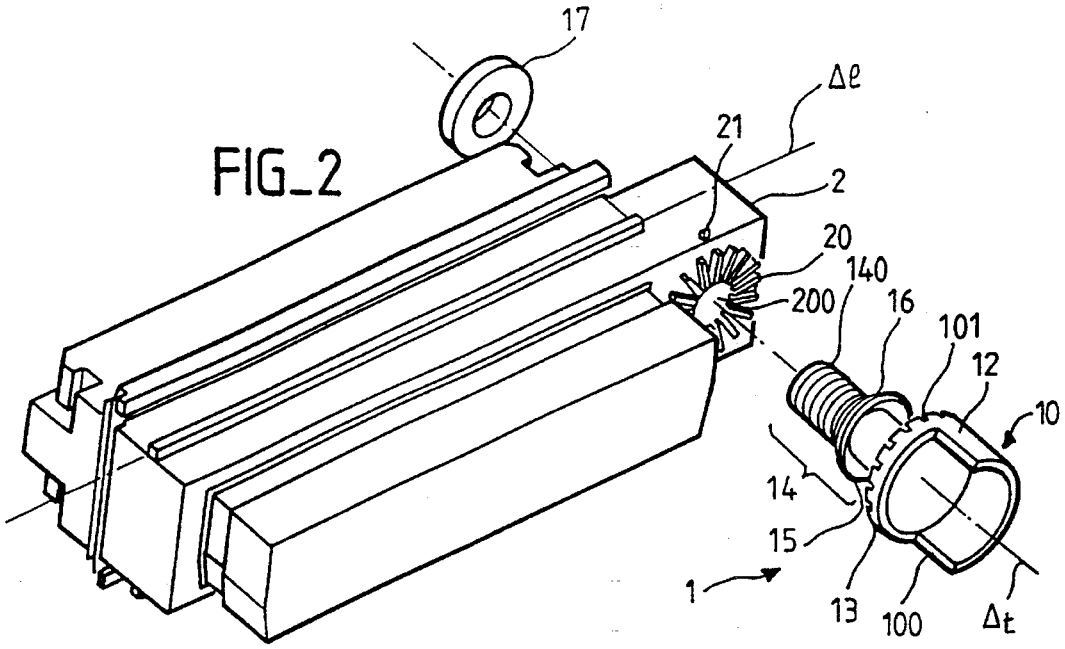
FIGS. 2 to 4 illustrate an example of embodiment of the attachment and locking device according to a first mode of embodiment according to the invention.
Figure 3:
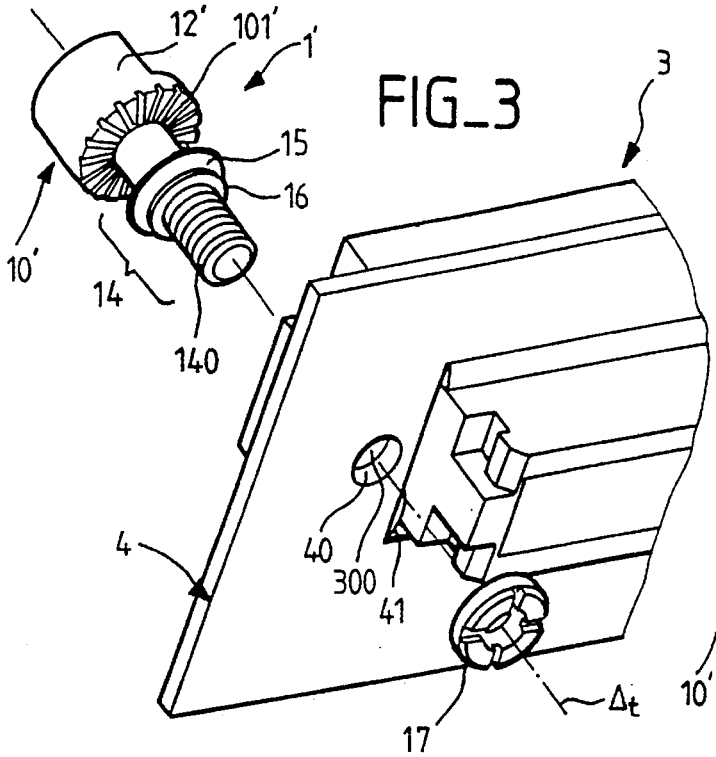
Figure 4:
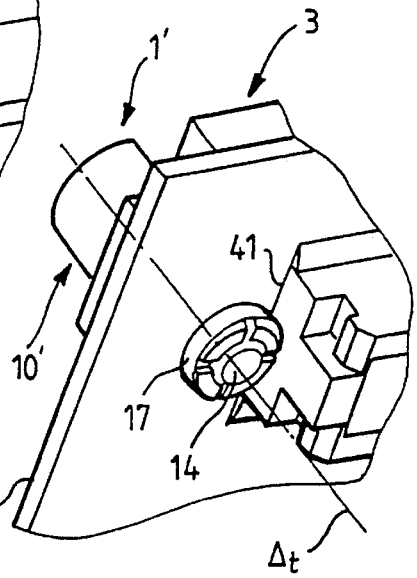

FIGS. 2 to 4 describe a first mode of embodiment that we will call the simplified mode of embodiment throughout the following.

In FIG. 2, a male casing 2 is shown, furnished, at one of its ends, with a crown piece of correction catches 20, according to one of the aspects of the invention that has just been described. The body of casing 2 is, moreover, given an opening 200, which passes completely through along a direction parallel to the transverse axis $\Delta_t$. This direction is orthogonal to the longitudinal axis, i.e., the parallel axis $\Delta_l$ at the largest dimension of casing 2.

The attachment and locking device 1 according to the invention is combined with a corrector.

The corrector part comprises a body 10 given a cylindrical skirt 12 furnished with a particular profile 100 and, on its outer bottom, a crown piece of correction catches 101. Skirt 12 of the body is of one piece with a shaft 14, threaded at least at its end 140, or a similar component. An elastic washer 15 and a washer 16 of the type called "serclip" or the like are threaded onto shaft 14. Shaft 14 and the washers are inserted into opening 200. A nut 17, positioned at the outlet of opening 200, is used to screw together the assembly. Before proceeding to tightening, a correction position is selected associated with this particular male casing 2 by positioning a number 13 facing guide mark 21.

FIG. 3 illustrates analogous arrangements employed for a female casing 3. In FIG. 3, the latter is viewed from the rear. Moreover, it is supposed that casing 3 has been attached onto a flat support 4, of the type called "basket support". To do this, an opening 40 is provided corresponding with opening 300 realized in the body of casing 3, of a function analogous to opening 200 of FIG. 2. An opening 41 has also been provided, of dimensions adapted to the body of casing 3. In this FIG. 3, the crown piece of correction catches 101' is shown, for which the base of body 10' of device 1' is shown. As before, attachment and locking device 1', associated with female casing 3, will be engaged in correction catches 30 (FIG. 1), not visible in FIG. 3.

Finally, FIG. 4 illustrates the blocked position, nut 17 entirely screwed onto threaded shaft 14.

As has been indicated, if, and only if, the two correction positions taken by body 10 and 10', of devices 1 and 1', are identical, the two casings (2: FIG. 2 and 3: FIGS. 3 and 4) can be coupled.

It is observed that attachment and locking device 1 according to the invention easily permits the assembly and attachment of casing 3 on support 4. It can be noted, in particular, that disassembly, as well as changing the correction position, only necessitates a simple unscrewing operation of nut 17.

In order to modify the correction position, a traction is exerted on body 10 or 10' of device 1 or 1' (parallel to the axis $\Delta_t$). A rotation is effected to change the correction position. Then, the traction is released, which permits again engaging the complementary correction catches 20 and 101, for example. This operation is rendered possible by the elasticity of washer 15 of device 1 according to the invention.

We will now describe a preferred mode of embodiment of the invention with reference to FIGS. 5 to 10*c*.

Figure 5:
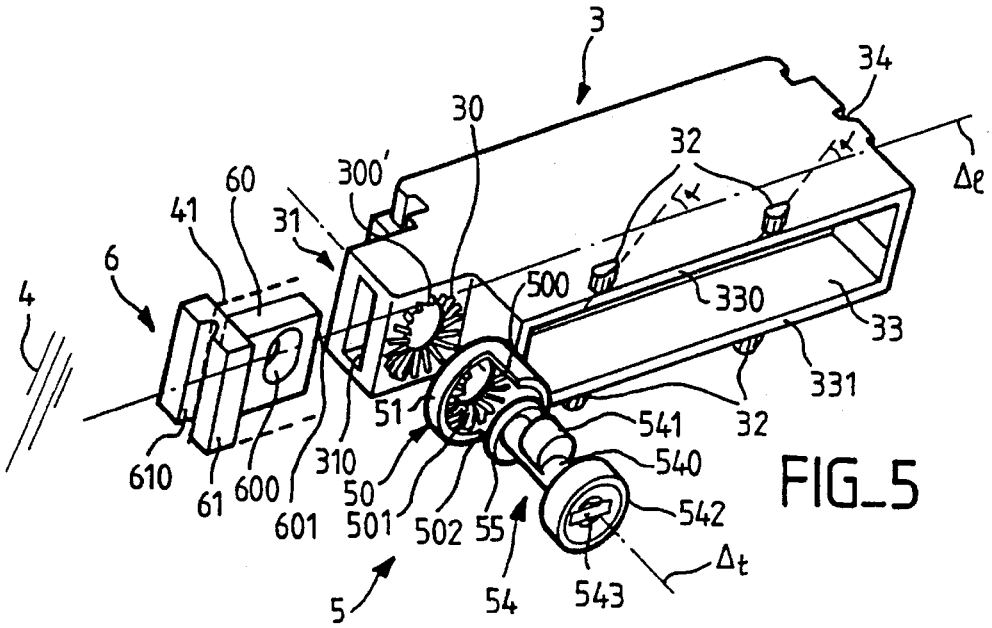
FIGS. 5 and 6 illustrate an example of embodiment of the attachment and locking device according to a second mode of embodiment of the invention, applied to a female connector.

FIG. 5 illustrates a female casing 3 furnished with an attachment and locking device 5 according to a preferred variant of embodiment of the invention.

This casing 3 has at one of its ends (to the right in FIG. 5) a hollow wing 31. The latter is furnished, as previously, with a crown of correction catches 3. Wing 31 has an opening 310, for example of roughly rectangular section, opening out, at the side of casing 3. A component 6, playing the role of a latch, as will be specified below, may be introduced by one of its ends 60 or by the main body, inside opening 310. It can be moved freely in this opening along a direction parallel to the longitudinal axis $\Delta_l$. Component 6 has a wing 61 provided with a vertical groove (in the figure), i.e., positioned along a direction orthogonal to the plane formed by axes $\Delta_t$ and $\Delta_l$. For reasons explained below, main body 60 is furnished with an oblong hole 600.

Contrary to the device 1, or 1', described by reference to FIGS. 2 to 4, within the scope of the simplified mode of embodiment, body 50 of device 5 is an autonomous cylindrical casing. It has a crown 51 of low height in the base region and a semi-cylinder 52 covering the remainder of the height, which is given a particular profile 500 similar to that which has been previously described.

According to this mode of embodiment, a locking component is provided that comprises a shaft 54, which is furnished, at a first end, with an elastic washer 55 and, at a second end, with a button 542, which will be called throughout the following "locking button". The latter is provided with a driving component 543, for example, a groove into which the point of a screwdriver or similar tool can be engaged.

Shaft 54 is furnished in its median zone 540 with a projection 541, in the form of a rounded sprocket.

The base of body 50 is given an opening 501 of oblong shape. The same is given to wing 31. In fact, opening 300', playing a role analogous to opening 300 previously described, is also of oblong shape and of identical size to that of opening 500.

In a first step, these two openings are made to coincide by bringing together the base of body 50 and crown 300'. Shaft 54 and first washer 55 are then introduced into these openings, as well as projection 541. Opening 300' (FIG. 5) is extended by an opening 300" opening on the rear surface (FIG. 6) of wing 31 of casing 3. The end of shaft 54 and its elastic washer 55 are threaded into this opening 300". The position of projection 541 on axis 540 of shaft 54 and its dimensions are such that it can be introduced entirely into cavity 310.

Casing 3 is normally introduced into an opening 41 (the dashed line in FIG. 5) made in a casing support 4 (simulated by the oblique lines in FIG. 5). Groove 610 is positioned on the left vertical section (in FIG. 5) of opening 41. In an advantageous manner, the profile of this groove has a configuration roughly "V" or "U" shaped. It can therefore accommodate a large range of thicknesses of support 4. Casing 3 also has, on its opposite end of wing 31, a vertical groove 34 of identical, or at least similar configuration, to groove 610.

It is easily realized that if shaft 54 is rotated around axis $\Delta_t$ in the trigonometric direction (in the example illustrated), said projection 541 will push against main body 60 of latch 6, if it is introduced into the cavity. Due to this, latch 6 exerts a pressure on the left section of cavity 41. Since the casing is held, on its right, by groove 34, it will be blocked in this position. Locking is obtained by a wedging effect of projection 541 on wall 601, positioned facing projection 541, in cavity 310, due to the rounded shapes, and this is true for projection 541, and for oblong hole 600.

It is therefore observed that device 5, according to the preferred mode of embodiment, permits not only an attachment of the casing onto a support 4, but also a very simple assembly and disassembly, since in reality, due to the arrangements made, the casing is removable. It is sufficient to turn shaft 54 in the reverse direction to unlock the casing and be able to remove it from its lodging (opening 541). To do this, advantageously, locking button 542 is used, in the manner described below in regard to FIGS. 10*a* to 10*c*.

The inner base of body 50 of attachment and locking device 5 is furnished with a crown piece of catches or teeth 502 that will be called "primary teeth" throughout the following. The same arrangement is made at the base of locking button 542: toothed crown 544, as is shown more precisely in FIG. 6. These two crowns engage in one another. Due to the elasticity of washer 55, the assembly of shaft 54 and body 50 of device 5 is pressed against the wall of wing 31 and, therefore, against the crown piece of correction catches 30. When shaft 54 is turned around axis $\Delta_t$, the two correction crowns catch 30 and 501 remain engaged, but by the ratchet effect, the primary catch crowns will be moved by a relative rotation movement, crown 501 remaining fixed, always by means of the elasticity of washer 55, which permits a partial drawing back of shaft 54 along the direction of axis $\Delta_t$. This permits unlocking the casing without changing the correction position selected.

The two functions are therefore autonomous.

Figure 7:
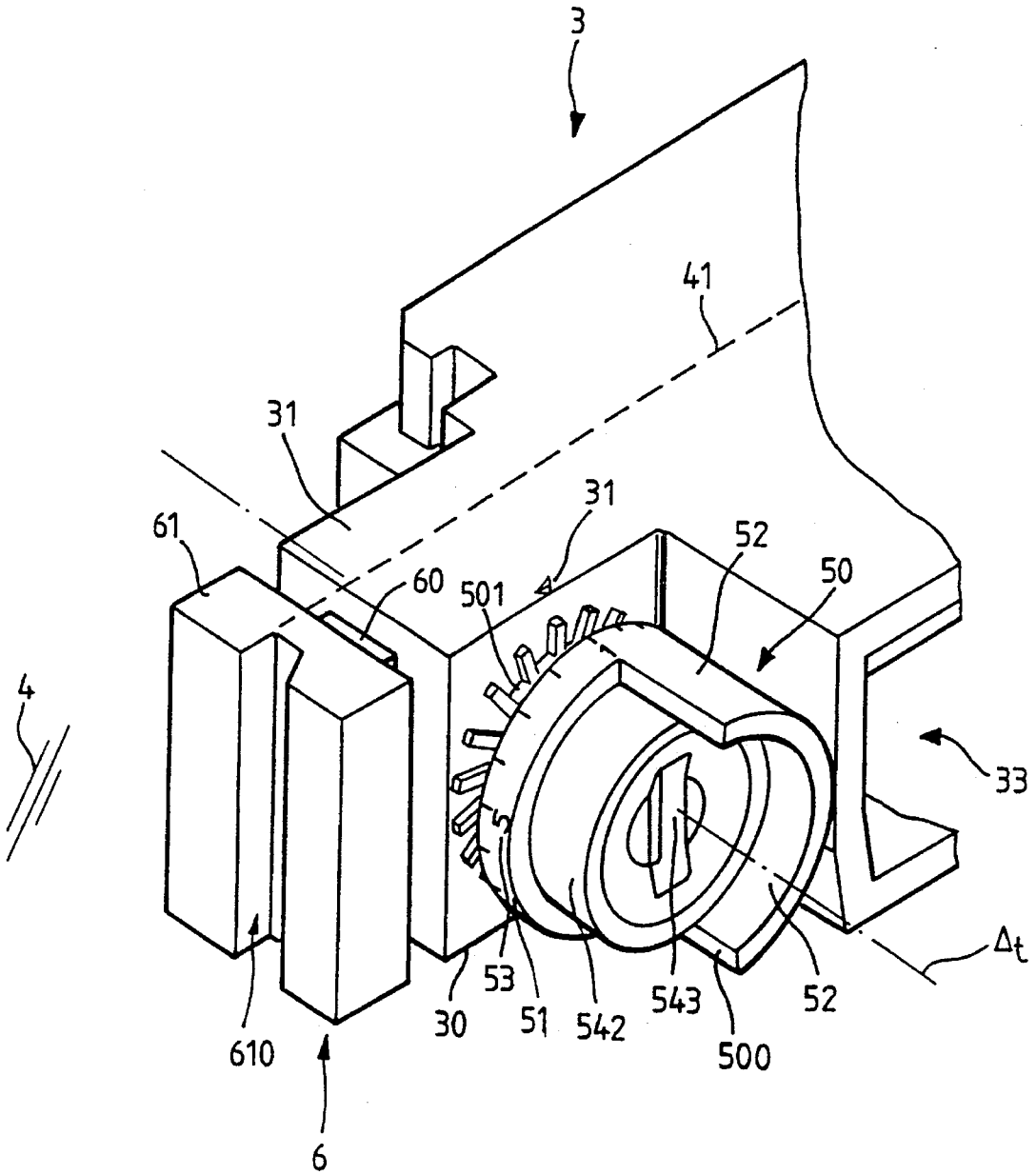
FIG. 7 is an enlarged figure illustrating the embodiment of an attachment and locking device according to the second mode of embodiment of the invention.

The selection, properly speaking, of the correction position is effected in the following manner:

In a first time, shaft 54 and its washer 55 are introduced into openings 300' and 300", and casing 3 is locked in its lodging 41, on support 4, as has just been described. This state is illustrated by FIG. 7, which represents device 5 on a larger scale, according to the second mode of embodiment of the invention.

Casing 3 has a guide mark 31. The correction position selected, in the example illustrated in FIG. 7, is position "1": number "1" of guide marks 53 of crown 51. To change the correction position or to choose one after locking casing 3 onto support 4, it is sufficient to pull back skirt 52 in the direction of axis $\Delta_t$, turning this skirt 52 in the desired rotation direction, and engaging again, in the position chosen, the correction catch crowns 501 (FIG. 6) and 30 (FIG. 5). To do this, one of the numbers 53 is positioned facing guide mark 31. The partial drawing back of skirt 52, driving shaft 54 in its translation movement, is permitted by the elasticity of washer 55 (FIG. 5). Once the traction force is released, skirt 52 and correction catch crown 501 are again applied against correction catch crown 30.

Figure 8:
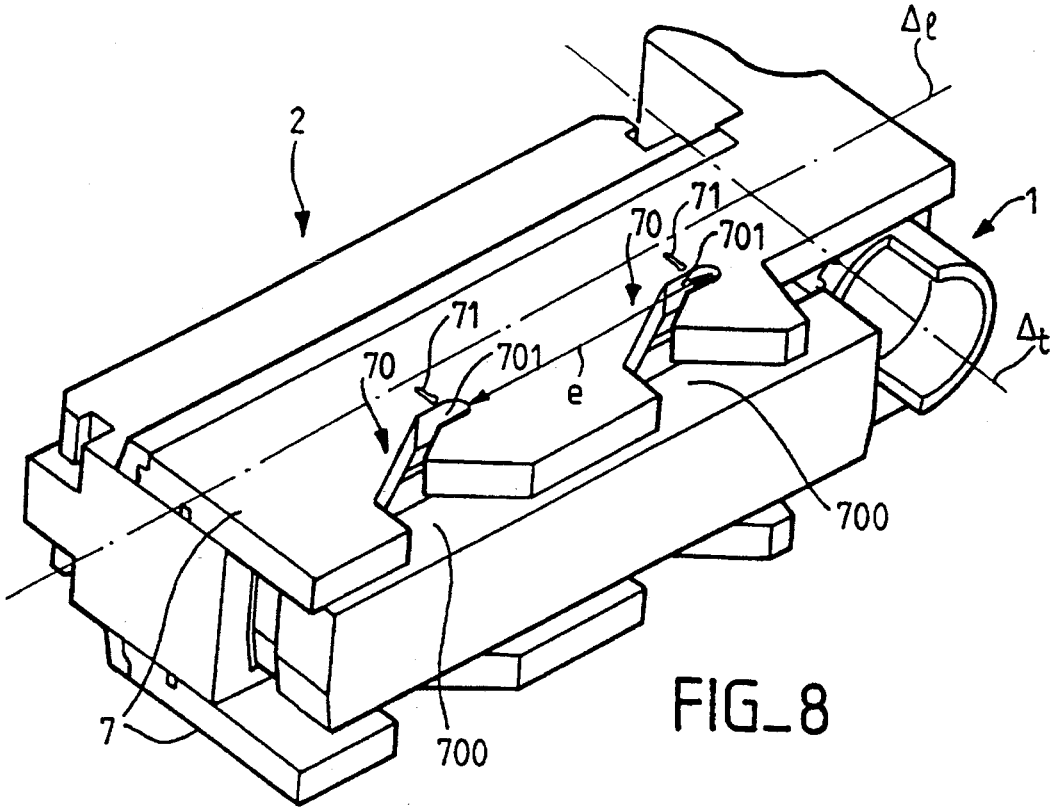
FIG. 8 illustrates an example of embodiment of the attachment and locking device according to a second mode of embodiment of the invention, applied to a male connector.

Female casing 3 has a front orifice 33 designed to receive a male casing 2, such as illustrated by FIG. 8. On the periphery of this orifice 33, studs 32 of an elongated form are positioned, forming an angle $\alpha$ with longitudinal axis $\Delta_l$. In the example illustrated, four studs 32 are provided, two on the upper lip 330 of orifice 33 and two on lower lip 331.

FIG. 8 illustrates a male casing 2. The latter, in the example illustrated, not needing to be attached onto a support, is furnished with a device 1 which can be at every point identical to device 1 illustrated by FIG. 2.

Figure 6:
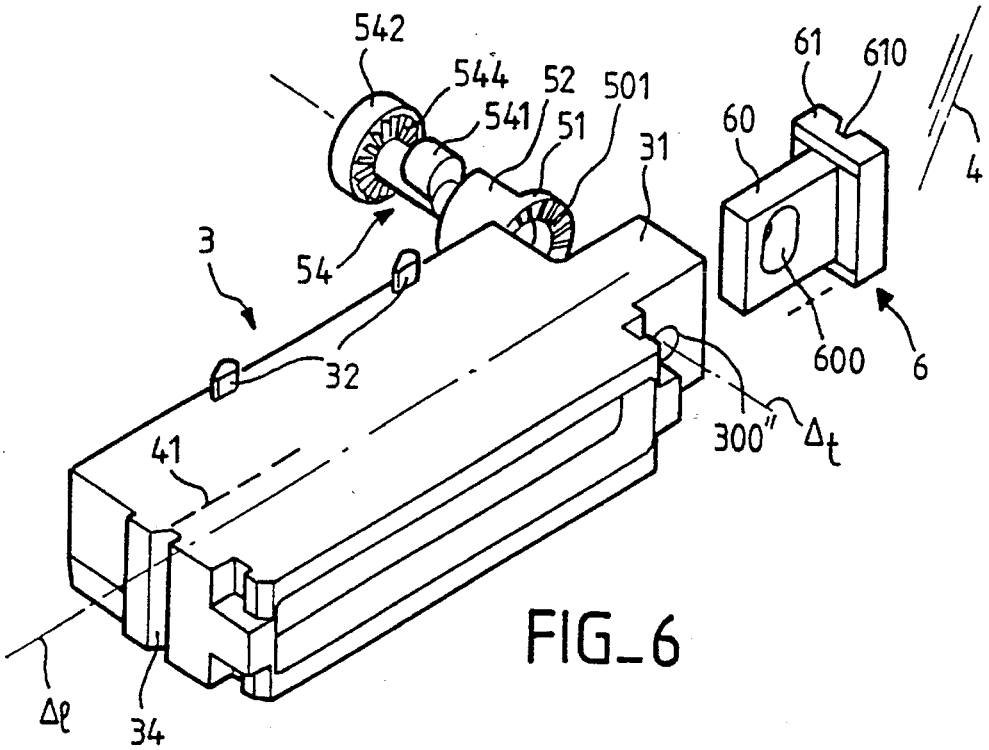

Casing 2 is furnished, moreover, with components 7 on its upper and lower surfaces (in the figure), and these are attached to the latter; components 7 will be called "locking collars" throughout the following. Each locking collar 7 is given two notches 70 having a flared frontal zone 700 opening toward the rear of casing 2, extended by a narrower, elbow channel 701; the final direction of this channel is roughly parallel to longitudinal axis $\Delta_l$. The position of the extreme walls of channels 701 and the distance separating them is determined such that these dimensions will be adapted to the configuration of pairs of studs 32 (FIGS. 5 and 6).

The flared shape of orifices 700 of grooves 70 favors the introduction of studs 32. The latter are then guided toward the extreme walls of channels 701, bringing about the locking of the male casing inside orifice 33 of female casing 3 and coupling of these two casings.

To aid the locking positioning, guide marks 71 can be provided on the visible surface of the locking crown, for example, in the form of arrows. Studs 32 will be placed facing the arrows.

Naturally, the coupling can only be effectively realized if the correction positions taken by the corrector part of device 5 associated with female casing 3 (FIGS. 6 and 7) and the correction part of device 1 associated with male casing 2 (FIG. 8) are in agreement (for example, if they are both in position "1" as illustrated).

Figures 9, 10A, 10B, 10C:
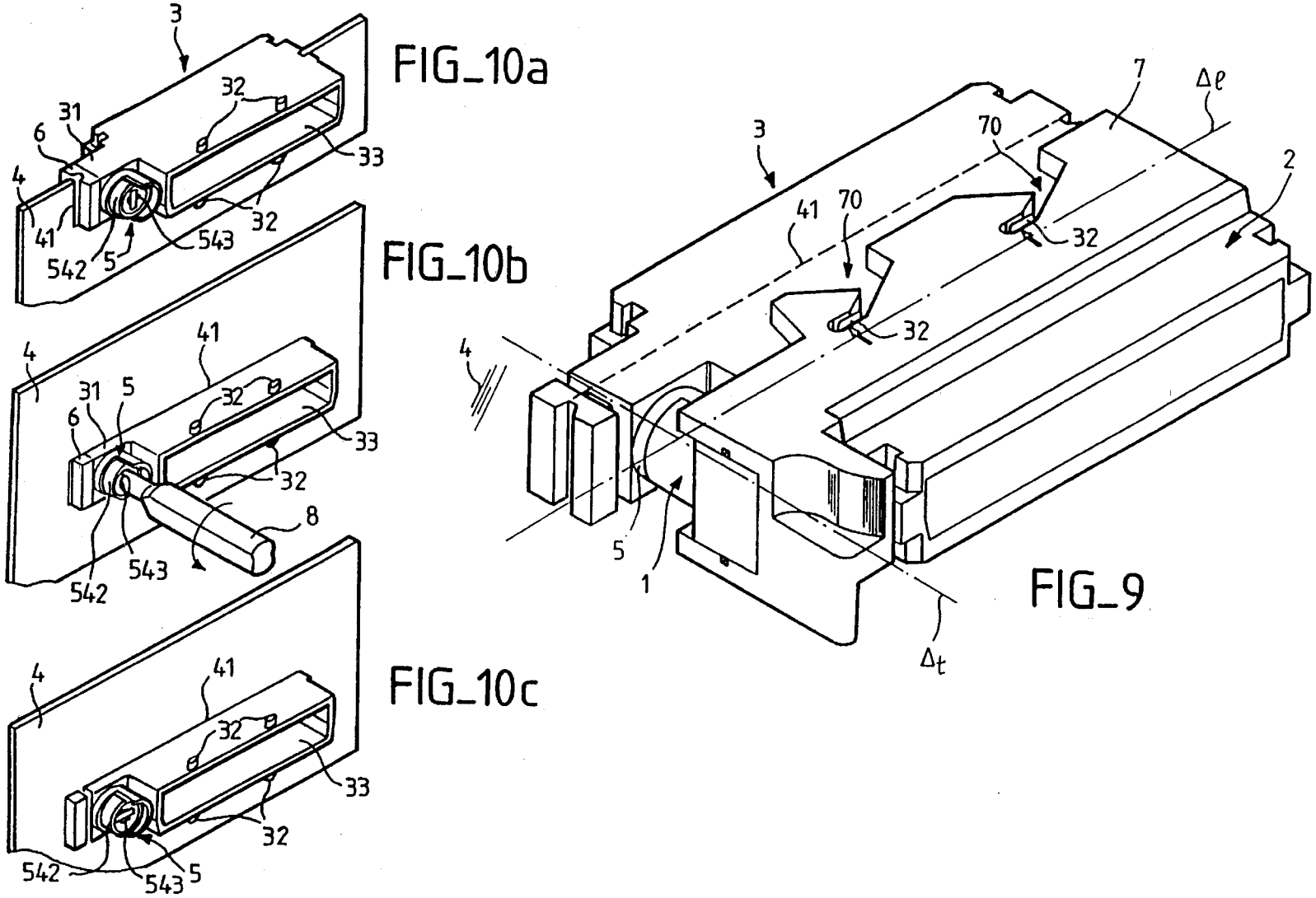
FIG. 9 illustrates the coupling of a male connector to a female connector, each furnished with an attachment and locking device according to the second mode of embodiment of the invention.
FIGS. 10*a* to 10*c* illustrate the assembly phases of a connector, furnished with an attachment and locking device according to the second mode of embodiment of the invention, onto a support panel.

FIG. 9 illustrates the state of final coupling of the two casings, male 2 and female 3. It is clearly seen, in FIG. 9, that the corrector parts of devices 1 and 5 are embedded in one another. The assembly then forms a complete cylinder.

FIGS. 10*a* to 10*c* illustrate the principal phases of assembly and locking of a female casing 3 onto a panel 4. This casing 3 is provided with a locking device or devices 5 according to the second variant of embodiment of the invention.

Casing 3 is first of all mounted onto partition 4 by inserting it into opening 41 provided for this purpose (FIG. 10*a*). The casing thus has "free play", because latch 6 is not pushed toward the left vertical section of opening 41.

Then, by means of a tool of the screwdriver type (in the example illustrated), locking button 542 is rotated. The end of screwdriver 8 is introduced into the driving slot 543. This rotation brings about, in turn, the rotation of shaft 54 (FIG. 5) and that of projection 541. Finally, the latter pushes latch 6 toward the left vertical section (in the figure) of opening 41, which locks male casing 3 in its lodging 41.

FIG. 10*c* illustrates the state of complete locking.

Figure 11:
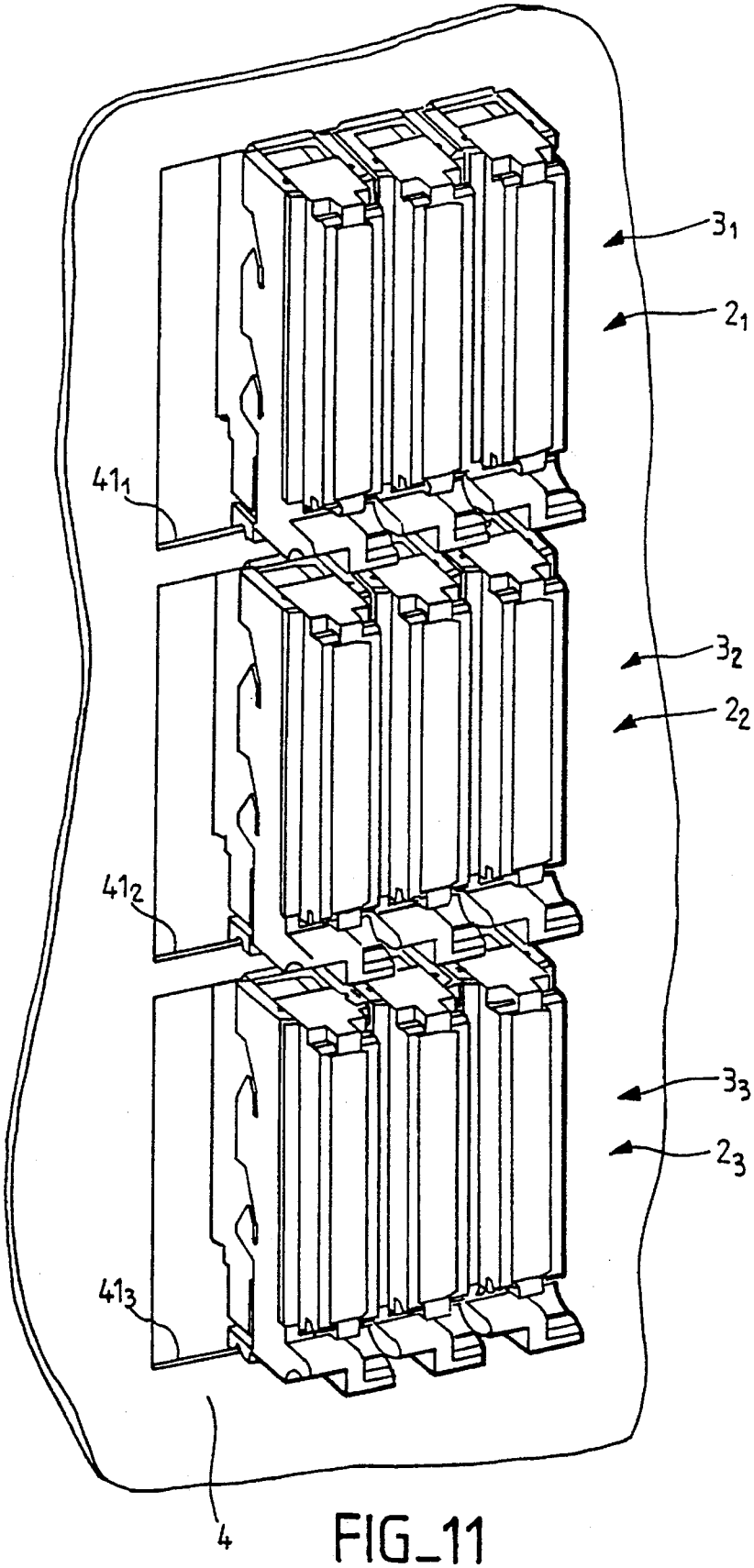
FIG. 11 illustrates a support panel having several connectors.

FIG. 11 illustrates schematically a complete panel 4, for support of male casings $\mathbf{2}_1$, $\mathbf{2}_2$, $\mathbf{2}_3$ and female casings $\mathbf{3}_1$, $\mathbf{3}_2$, $\mathbf{3}_3$. In the example illustrated, the panel has three lodgings $\mathbf{41}_1$, $\mathbf{41}_2$, and $\mathbf{41}_3$. Casings $\mathbf{2}_1$, $\mathbf{2}_2$, $\mathbf{2}_3$, and $\mathbf{3}_1$, $\mathbf{3}_2$, $\mathbf{3}_3$, are positioned vertically, side by side. Although three connectors have been shown in each lodging, this number is purely arbitrary. It is the same for the number of lodgings $\mathbf{41}_1$, $\mathbf{41}_2$, and $\mathbf{41}_3$. The type of attachment and locking device, first or second variant of embodiment, can be of any type. These types of attachment and locking devices can also be mixed.

In a supplementary variant of embodiment, not illustrated, two attachment and locking devices are provided per casing. Advantageously, each of the attachment and locking devices can be marked differently, for example, by giving them colors. Still by way of example, one of the attachment and locking devices of each casing can be colored red and the other colored green.

It should be clear that the invention is not limited only to the examples of embodiment specifically described, notably in relation to FIGS. 2 to 11.

As has been indicated, the preferential applications of the invention are in the field of connections, more particularly in aeronautical, civil or military connections.

What is claimed is:

1. A system for attaching and locking a first module onto a support, the system having correction means for limiting connection of a second module to the first module, the system comprising:

a first array of correction catches on a first surface of the module, the module having an opening passing therethrough proximate the first array;

a body having a second array of correction catches, a threaded shaft, and a profile section, the threaded shaft extending through the opening in the module with the second array of correction catches interlocked with the first array of correction catches on the first surface of the module; and a fastener attached to the threaded shaft on a side of the module opposite the first surface, wherein position of the profile section relative to the first module is configurable by the position of the first and second arrays of correction catches relative to each other to prevent the second module from being connected to the first module unless the second module has a profile section that is configured and orientated to mate with the profile section of the body.

2. A system as in claim 1 wherein the number of correction catches of the first array equal the number of correction catches of the second array.

3. A system as in claim 1 further comprising an elastic washer on the threaded shaft between the fastener and the module wherein the body and the fastener can be moved relative to the module by compression of the elastic washer.

4. A system as in claim 1 wherein the support has an aperture aligned with the hole in the module and, the threaded shaft extends through the aperture with the support being sandwiched between the module and the fastener.

5. A system as in claim 1 further characterized in that said correction catches of said first array are positioned on a periphery of a circular crown, and in that said body is a cylindrical casing having an axis merged with a reference axis with an outer base wall provided with a crown piece of correction catches, forming said second array, and in that an upper part of said body is cut away so that said profile section is a half cylinder.

6. Attachment and locking device of a module of a first type onto a support, characterized in that the device is provided with correction means comprising:

a first correction catch assembly supported by one surface of the module and having a specific number of catches;

a body with a cut out having a specific profile and, on a surface facing the first correction catch assembly, a second correction catch assembly with a number of catches equal to said specific number of the first correction catch assembly;

a shaft, extending in a direction parallel to a reference axis, the shaft having a projection in a median zone and having elastic means on a first end of the shaft, wherein the module has a cavity and a first opening that opens into said cavity, the first opening being located in a central zone of said first correction catch assembly and having a size to allow passage of said shaft and said projection, the module also having a second opening with a size to allow passage of at least the first end of said shaft to a surface opposite said first assembly;

wherein said body is a cylindrical casing furnished with an opening of sufficient size to allow passage of said shaft and said projection, the first and second openings of the module extending in a direction parallel to said reference axis, the relative sizes of said projection and said cavity being such that said projection can be moved into said cavity when said shaft is rotated around said reference axis;

wherein said cavity communicates with the outside of said module, and further comprising a component forming a latch, the component being movably mounted in said cavity so as to be able to be moved with a translation movement along an axis orthogonal to said reference axis;

wherein said shaft permits ratcheting into a specific position relative to said second correction catch assembly on said first correction catch assembly, defining a particular correction position among a number of positions equal to said specific number, each particular position defining a distinct spatial position of said specific profile with regard to the reference axis, so as to permit a coupling of the module to a second module of the type complementary to said first type and comprising correction means.

7. Attachment and locking device according to claim 6, wherein the elastic means comprises an elastic washer on the shaft permitting a translation of said body along the reference axis comprising rotation around the reference axis for definition of a new correction position.

8. Attachment and locking device according to claim 6 wherein the shaft has a locking button on a second end.

9. Attachment and locking device according to claim 8 wherein a surface of the locking button that faces an inner base of the body is provided with a second series of teeth that engage the first series of teeth, wherein the shaft is rotatable without moving the body.

10. Attachment and locking device for a module of a first type onto a support, the module comprising at least one such locking device, characterized in that said module has an opening passing completely therethrough along a direction parallel to a reference axis, a shaft provided with a projection in a median zone and supporting elastic means on a first end;

wherein said module has a cavity, a first opening on a first surface that opens into said cavity, the first opening being of sufficient size to permit passage of said shaft and said projection, and a second opening on a second surface opposite the first surface, the second opening being of sufficient size to allow passage of at least a first end of said shaft, the first and second openings extending in a direction parallel to said reference axis, the relative sizes of said projection and of said cavity being such that said projection can be moved in the cavity when shaft is rotated around said reference axis;

wherein said cavity communicates with the outside of said module; and further comprising a component forming a latch movably mounted in said cavity so as to be able to move with a translation movement along an axis orthogonal to said reference axis.

11. Attachment and locking device according to claim 10, further characterized in that said shaft has, at a second end, a locking button that can be activated by a tool to induce rotation of shaft and the translation of said component.

* * * * *